United States Patent [19]

Hout

[11] Patent Number: 4,578,905

[45] Date of Patent: Apr. 1, 1986

[54] MODULAR WINDOW UNIT

[75] Inventor: Bertus O. Hout, Merrill, Wis.

[73] Assignee: Semling-Menke Company, Inc., Merrill, Wis.

[21] Appl. No.: 699,348

[22] Filed: Feb. 7, 1985

Related U.S. Application Data

[63] Continuation of Ser. No. 137,904, Apr. 7, 1980, abandoned.

[51] Int. Cl.[4] ..... E06B 1/04

[52] U.S. Cl. ..... 49/504; 49/467

[58] Field of Search ..... 49/504, 380, 505, 467–471; 52/212, 213, 217

[56] References Cited

U.S. PATENT DOCUMENTS

| | | | |
|---|---|---|---|
| 3,259,086 | 7/1966 | Stein | 52/484 X |
| 3,402,512 | 9/1968 | Peterson | 49/468 |
| 3,473,266 | 10/1969 | Miller | 49/504 |
| 3,694,961 | 10/1972 | Johnson | 49/504 X |
| 4,122,633 | 10/1978 | Holdiman | 49/504 X |
| 4,207,707 | 6/1980 | Holdiman et al. | 49/504 X |
| 4,237,664 | 12/1980 | Wilmes | 49/471 X |

*Primary Examiner*—Philip C. Kannan

*Attorney, Agent, or Firm*—Ronald E. Barry

[57] ABSTRACT

A prefabricated unit including a wooden frame formed by a number of sections including a pair of jambs, a sill, and a header with a door or window operatively positioned in the frame and a plurality of metal frame extenders mounted on the exterior of each section of the wooden frame, the metal extenders being provided with a nailing fin that can be pivotally moved from a closed position for shipment and storage to an open radially outwardly extending position for attachment of the unit to an opening provided in a building.

2 Claims, 2 Drawing Figures

MODULAR WINDOW UNIT

This is a continuation, of application Ser. No. 137,904, filed 4-7-80, now abandoned.

BACKGROUND OF THE INVENTION

Prefabricated units are commonly used in the construction of buildings, such as homes, apartments and office buildings. The prefabricated unit is positioned within a opening provided in the frame of the building and is secured to the opening by nailing fins that extend outwardly from the exterior of the frame unit. If the nailing fins are provided with the frame unit, difficulties are encountered in storage and transport due to the susceptibility of the nailing fins to be bumped and broken. Where separate nailing fins are provided, they must be matched to the appropriate frame section and inserted as needed for securing the unit to the frame of the house.

SUMMARY OF THE INVENTION

The prefabricated unit according to the present invention is provided with nailing fins around the outer periphery of the frame extenders. The nailing fins include a flat blade section with a laterally offset bead or rib which is positioned in a slot in the frame extender to allow the nailing fin to be pivoted from a stored position adjacent to the outer surface of the prefabricated unit to an open position extending radially outward from the periphery of the prefabricated unit. The nailing fin is thus protected from damage during shipment and storage by being mounted adjacent the outer peripheral surface of the frame extender and can be readily prepared for use by pivoting the nailing fin outward to a position where it will lie against the outer surface of the frame of the building.

THE DRAWINGS

DETAILED DESCRIPTION OF THE INVENTION

Figure 1:
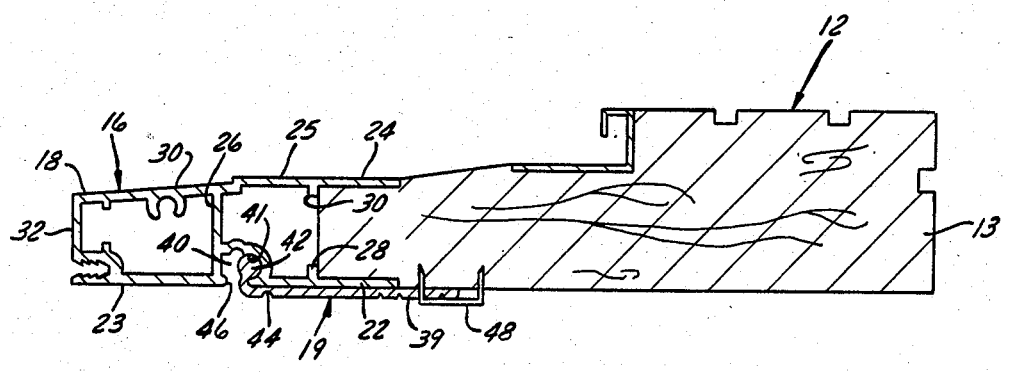
FIG. 1 is a sectional view of one of the sections of a prefabricated frame unit showing the nailing fin mounted in the extender and pivoted to a closed or stored position.

Prefabricated window or door units are commonly used in the construction of a building or house. The units are merely inserted into an opening provided in the building and secured thereto by nailing fins. The prefabricated unit 10 according to the present invention generally includes a wooden frame 12 made from a plurality of sections or members 13 which can consist of a pair of window jambs, a window sill, and a header with one or more windows 14 operatively positioned in the wooden frame and movable relative thereto. The wooden frame 12 is provided with an external metal frame 16 comprised of a plurality of extruded metal extenders 18 which individually are engaged or attached to the wooden frame sections. The extenders 18 form the exterior configuration of the window frame.

In accordance with the present invention, means are provided on the sides of the extenders for securing the prefabricated unit to the wall 20 around the opening in a building. Such means is in the form of a nailing fin 19. In this regard, each of the nailing fins 19 are supported on the extenders 18 as seen in FIG. 1. Each of the extenders is formed from an aluminum extrusion which is hollow and includes an outer wall 23 and an inner wall 25 interconnected by a central web 26. The extender is secured to the wooden members 13 by means of a pair of flanges 22, 24 which extend inwardly from the outer walls 23 and inner wall 25, respectively, in a parallel spaced relation. The flanges 22, 24 overlap the outside and inside surfaces of the wooden frame members 13. Rib means 28 and 30, respectively, are provided on the inside surface of the walls 23, 25 to limit the penetration of the member 13 into the space between the flanges 22, 24. The outside wall 23 is flush with the outside surface 15 of the frame member 13 and extends outward therefrom terminating at an external wall 32. The inside wall 25 includes a tappered section 30 which extends outward from the web 26 and also terminates at external wall 32. The metal frame extenders 18 preferably are made as metal extrusions and can be made of any conventional material such as aluminum. The wall 23, tappered section 30 and end wall 32 form the external configuration of the frame unit and also provide an attractive finish contour to the unit.

Figure 2:
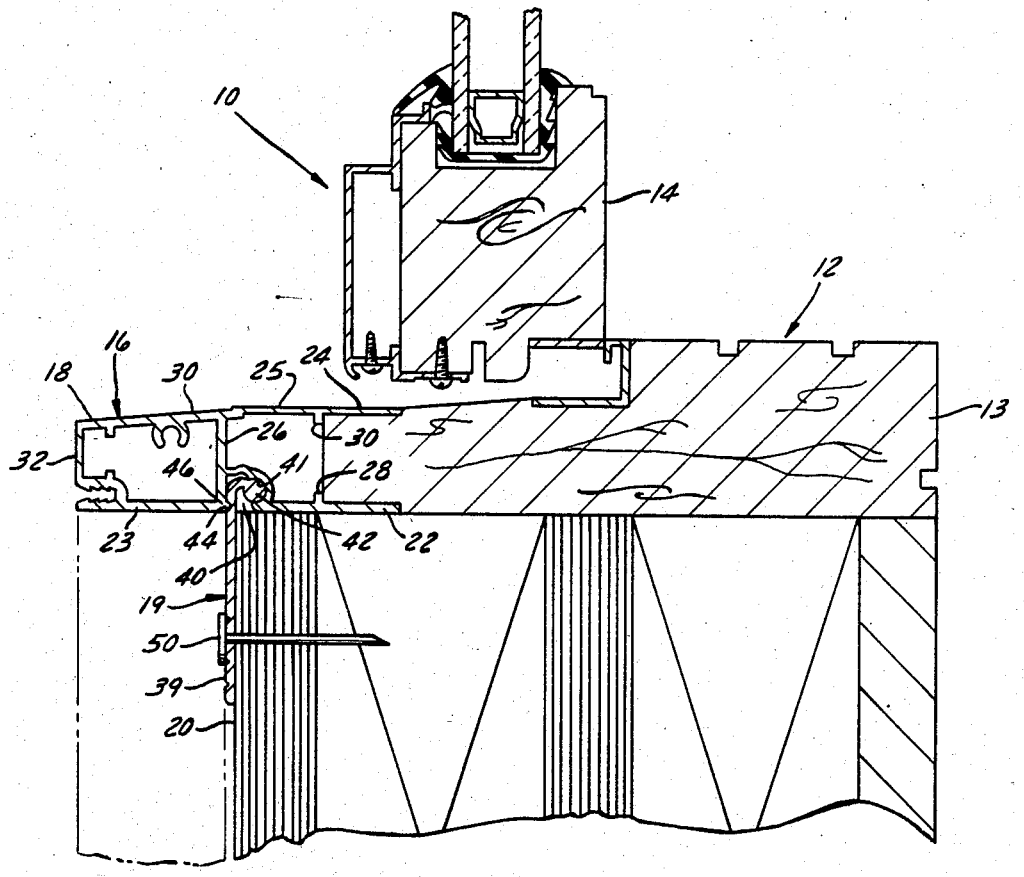
FIG. 2 is a fragmentary section view showing one of the section of the prefabricated unit seated in the opening of a building with the nailing fin pivoted to a position for engagement with the outer surface of the building.

The principal feature of the invention is the provision of a pivotal support for the nailing fin 19. This enables the fin 19 to be moved from a storage position adjacent to the outside surface of the building to an open position projecting outwardly from the building. This is accomplished by providing a slot 40 in wall 23 of the extender 18 adjacent to the central web 26. The nailing fin 19 includes a flat blade section 39 and a round laterally offset bead 42 on one edge of said blade section. The bead 42 fits in a corresponding annular portion 41 of the slot 40. The bead is rotatable in the annular portion 41 of the slot 40 and thus provides a pivot point for rotation of the nailing fin 19 to a position projecting radially outwardly from the wooden frame. Means are provided on the surface of the blade section 39 of the nailing fin 19 for locking the fin in the outwardly projecting position. Such means is in the form of a notch 44 which engages the edge 46 of the wall 23 as seen in FIG. 2.

The nailing fin 19 is normally stored and transported in a position adjacent to the outer surface of the frame members 13. Means in the form of a staple 48 can be used to hold the fin 19 in the stored position. When the prefabricated unit is ready to be placed in the opening of a building, the staple 48 is removed and the fin 19 pivoted to the open position. The fin 19 should be rotated far enough for the edge 46 of the wall 23 to seat in the notch 44 provided on the surface of the nailing fin 19. After the prefabricated unit has been seated in the opening provided in the frame of the building, the nailing fin 19 is attached to the building 20 by nails 50.

The embodiments of the invention in which an exclusive property and privilege is claimed are defined as follows:

1. A prefabricated window frame unit of the type which is adapted to be mounted in an opening in a building, the unit including a wooden frame including a number of wooden sections to define the outer peripheral surface of the frame, and a plurality of metal frame extenders secured to each of the sections of the frame to form the external configuration of the unit, each extender having a wall portion extending outwardly from the outer peripheral surface of the frame sections, said wall portion including a slot having an annular portion and a ridge along one edge of the slot, and a nailing fin including a flat blade section having a notch in the outer surface and a laterally offset bead, said bead being pivotally mounted in said annular portion of said slot in said extenders for movement from a storage position adjacent to the peripheral surface of the frame sections to an open position extending outwardly therefrom for attachment to the building, said fin being locked in the open position by the engagement of said notched with said ridge in said slot.

2. A prefabricated unit for a door or window, said unit including a frame adapted to be mounted in an opening in a wall, a metal extender secured to said frame on the exterior surface thereof, and having an outer wall forming an extension of the frame, said extender including an annular slot in the outer wall of the extender and a ridge along one edge of the slot, and nailing means pivotally mounted on the outer wall of said metal extender for nailing said frame to the wall, said nailing means including a flat blade section having a bead along one edge of the blade section and a notch in one surface of the flat blade section parallel to the bead, said bead being positioned in said slot to pivotally support said blade section for movement from a position adjacent to the outer wall of the extender to a position extending radially outward from the wall, said blade being locked in the outer position by the engagement of the notch with the ridge in the slot.

* * * * *